US006848661B2

(12) United States Patent
Baldasari

(10) Patent No.: US 6,848,661 B2
(45) Date of Patent: Feb. 1, 2005

(54) ADJUSTABLE BASKETBALL GOAL SYSTEM AND MOUNTING METHOD

(76) Inventor: Alan D. Baldasari, 405 Buffalo Rd., Negaunee, MI (US) 49866

( * ) Notice: Subject to any disclaimer, the term of this patent is extended or adjusted under 35 U.S.C. 154(b) by 0 days.

(21) Appl. No.: 10/405,580

(22) Filed: Apr. 3, 2003

(65) Prior Publication Data

US 2004/0195478 A1 Oct. 7, 2004

(51) Int. Cl.[7] ..... A47B 96/06
(52) U.S. Cl. ..... 248/218.4
(58) Field of Search ..... 248/284.1, 324, 248/325, 123.11, 218.4, 910, 280.11, 631

(56) References Cited

U.S. PATENT DOCUMENTS

| | | | | | |
|---|---|---|---|---|---|
| 4,320,896 | A | | 3/1982 | Engle et al. | |
| 4,438,923 | A | | 3/1984 | Engle et al. | |
| 4,583,732 | A | | 4/1986 | Allen | |
| 4,676,503 | A | | 6/1987 | Mahoney et al. | |
| 4,739,988 | A | | 4/1988 | Schroeder | |
| 4,846,469 | A | | 7/1989 | Nye | |
| 5,066,007 | A | | 11/1991 | Niver | |
| 5,071,120 | A | | 12/1991 | Dadbeh | |
| 5,106,084 | A | | 4/1992 | Vaught | |
| 5,133,547 | A | * | 7/1992 | Pardi | 473/484 |
| 5,154,414 | A | | 10/1992 | Auer et al. | |
| 5,318,289 | A | | 6/1994 | Mahoney et al. | |
| 5,348,289 | A | | 9/1994 | Vaught | |
| 5,478,068 | A | * | 12/1995 | Schroeder | 473/484 |
| 5,570,880 | A | | 11/1996 | Nordgran | |
| 5,628,506 | A | | 5/1997 | Vaught | |
| 5,685,790 | A | | 11/1997 | Vaught | |
| 5,716,294 | A | | 2/1998 | Childers et al. | |
| 5,720,679 | A | * | 2/1998 | Schroeder | 473/484 |
| 5,816,948 | A | | 10/1998 | Davies, Jr. et al. | |
| 5,816,955 | A | | 10/1998 | Nordgran et al. | |
| 5,879,247 | A | * | 3/1999 | Winter et al. | 473/484 |
| 5,919,102 | A | * | 7/1999 | Smith et al. | 473/484 |
| 6,001,034 | A | | 12/1999 | Schickert et al. | |
| 6,155,938 | A | * | 12/2000 | Mower | 473/484 |
| 6,296,583 | B1 | | 10/2001 | Tatar, Sr. | |
| 6,302,811 | B1 | * | 10/2001 | Topham | 473/484 |
| 6,334,822 | B1 | | 1/2002 | Zider | |
| 6,402,644 | B2 | * | 6/2002 | Stanford et al. | 473/484 |
| 6,419,597 | B1 | * | 7/2002 | van Nimwegen et al. | 473/484 |
| 6,419,598 | B1 | | 7/2002 | Winter et al. | |
| 6,447,409 | B1 | | 9/2002 | Squibb | |
| 6,488,599 | B2 | * | 12/2002 | Nye | 473/483 |
| 6,503,160 | B2 | | 1/2003 | Hehr | |
| 6,554,724 | B2 | | 4/2003 | Taylor | |
| 6,663,065 | B1 | * | 12/2003 | Whittenburg | 248/219.1 |
| 2003/0040383 | A1 | * | 2/2003 | Squibb | 473/481 |

* cited by examiner

*Primary Examiner*—Leslie A. Braun
*Assistant Examiner*—Kofi Schulterbrandt
(74) *Attorney, Agent, or Firm*—Banner & Witcoff, Ltd

(57) ABSTRACT

Systems and methods are provided for adjustable basketball goal systems, and methods for setting up such systems. In one embodiment of the invention, a basketball goal system is provided that includes a backboard that can be moved to be substantially vertical, and a rim that can be moved to be substantially horizontal. In other embodiments of the invention, the basketball goal system includes a neck that can be moved to adjust the height of the rim to a desired height above the playing surface. In one embodiment, a basketball goal system includes a shock absorption system that permits the neck, backboard and rim of the system to move downward to absorb severe shocks, and that automatically returns them to their playing position. Other embodiments include a vehicle-mounted support. Some of the embodiments may be attached to a vehicle-mounted support.

14 Claims, 14 Drawing Sheets

ADJUSTABLE BASKETBALL GOAL SYSTEM AND MOUNTING METHOD

FIELD OF THE INVENTION

This invention relates generally to sports equipment. More particularly, the invention concerns adjustable basketball goal systems and methods for mounting such systems.

BACKGROUND OF THE INVENTION

Basketball equipment is well known. Many neighborhoods include a number of homes and/or parks where children or adults gather to play recreational basketball. Prior art basketball systems generally include permanent systems and portable systems.

Conventional permanent basketball goal systems generally include a basketball hoop attached to a backboard. The backboard is typically affixed to a vertical pole such that the backboard is attempted to be placed vertical and the goal is attempted to be placed horizontal. In addition, the vertical pole is usually attempted to be placed plumb. The installer typically does not need to worry about the tilt of the backboard or the angle of the rim as long as the pole is plumb. These permanent systems suffer from the disadvantage of not being movable to different locations as desired. Further, during extreme playing conditions, the rigid system including a basketball rim and other elements may be unable to absorb severe shocks and may fail.

Breakaway rims have been developed as an attempt to avoid such problems. In one type of breakaway rim design, these rims must be re-installed after they disconnect from the backboard, which undesirably interrupts play of the game. In another type, the rim rotates downward to absorb shocks; however, such rims are unable to absorb severe shocks and often fail.

Due to the popularity of the game, portable basketball goal systems are very appealing and increasingly commonplace. Portable basketball goal systems typically include a base that rests on the ground, a vertical pole connected to the base, and a backboard and rim connected to the vertical pole. The vertical pole is usually either perpendicular to the base or slightly angled in a forward direction toward the basketball rim. The backboard and rim of such portable systems are generally attached in a fixed orientation relative to the vertical pole and base. Thus, if the surface on which the base rests is uneven, the backboard and rim are correspondingly uneven. This can result in unsatisfactory play conditions and frustrating attempts by the players to repeatedly level the base. Although many of these systems provide for vertical adjustment of the hoop and backboard to accommodate various ages and abilities of the players, such adjustment does not address leveling problems.

These portable systems are generally less robust than permanent systems. Additionally, these systems may wobble or shift during play. To provide stabilizing support to the system, the base of many conventional portable basketball goal systems are weighted. For example, the base may include a ballast cavity, which can be filled with water or sand. The weighted base can sometimes stabilize the system during light to moderate play conditions, but typically fails to provide adequate support during heavier play conditions. Due to shifting of the base during extreme play, total failure of the system is unlikely but the shifting can be frustrating to the players during play of the game.

Thus, a need exists for improved basketball goal systems, and methods for setting up such systems, that can provide many of the advantages of prior art systems without many of the disadvantages.

SUMMARY

In order to overcome the above-described problems and other problems that will become apparent when reading this specification, the present invention provides basketball goal systems, and methods for setting up such systems, in which the orientation of the backboard and/or rim can be adjusted, or in which the orientation of an interface to the backboard and/or rim can be adjusted. In an embodiment of the invention, a basketball goal system is provided that includes a backboard that can be moved (e.g., tilted) to be substantially vertical, and a rim that can be moved to be substantially horizontal. In other embodiments of the invention, the basketball goal system includes a neck that can be moved to adjust the height of the rim to a desired height above the playing surface.

In one embodiment, the basketball goal system includes a shock absorption system that permits the neck, backboard and rim to move downward to absorb severe shocks, and that preferably automatically returns them to the pre-shock playing position. Some embodiments may be attached to a vehicle support, which provides an extremely mobile basketball goal system. Other features and advantages of the invention will become apparent with reference to the following detailed description and figures.

BRIEF DESCRIPTION OF THE DRAWINGS

The invention will be described in detail in the following description of preferred embodiments with reference to the following figures wherein.

DETAILED DESCRIPTION OF THE DRAWINGS

In the following description of the various embodiments, reference is made to the accompanying drawings that form a part hereof, and in which is shown by way of illustration various embodiments in which the invention may be practiced. It is to be understood that other embodiments may be utilized and structural and functional modifications may be made without departing from the scope of the present invention.

Figure 1:
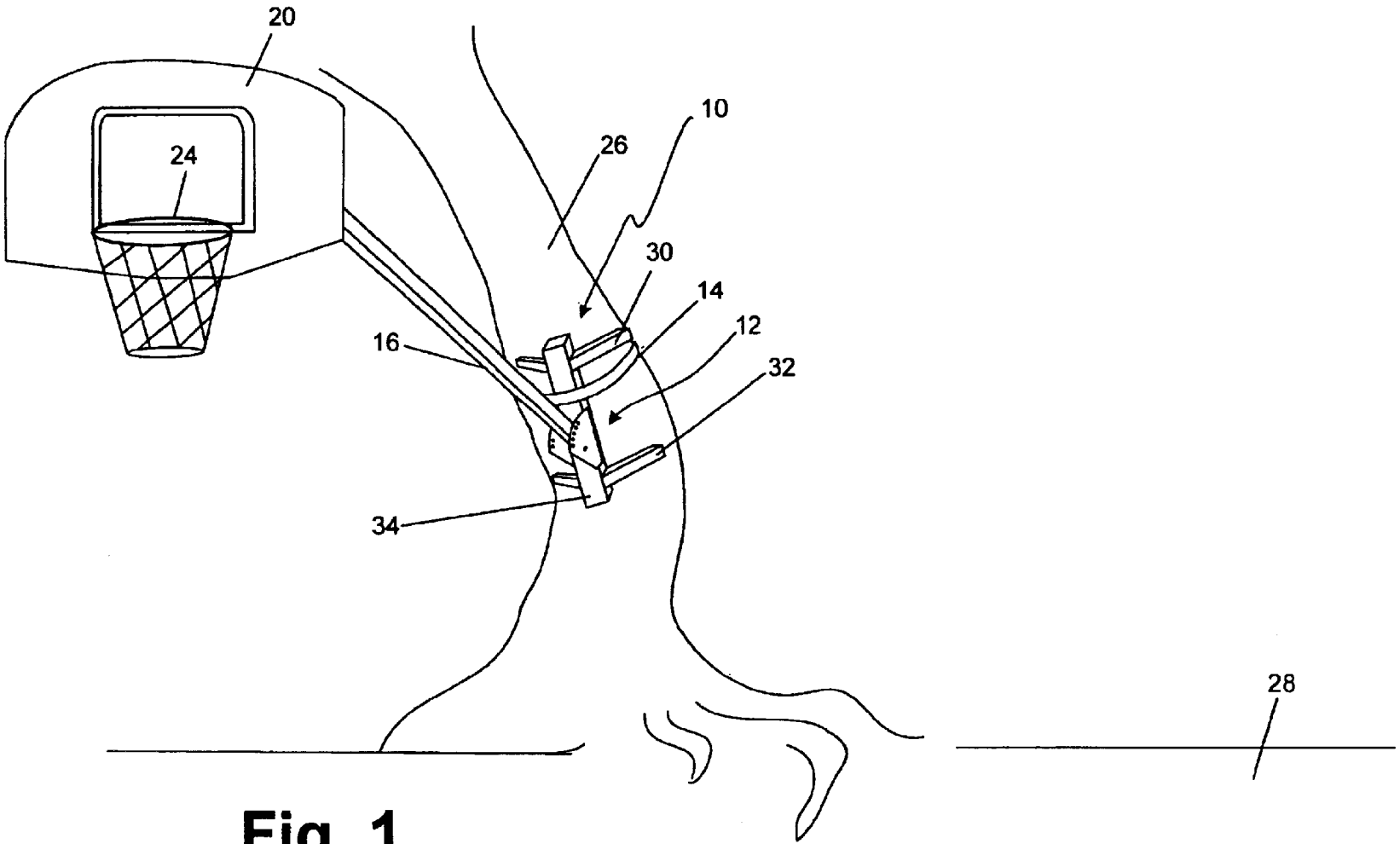
FIG. 1 is a perspective view of a basketball goal system according to an embodiment of the invention, which is shown attached to tree.

Referring now to FIGS. 1–4, a basketball goal system 10 is shown according to an embodiment of the invention. Basketball goal system 10 generally includes a base 12, an attachment strap 14, a neck 16, a height adjustment interface 18 pivotally connecting base 12 to neck 16, a backboard 20, a leveling bracket 22 rotatably connecting backboard 20 to neck 16, and a rim 24 attached to backboard 20. As shown in FIG. 1, basketball goal system 10 may be attached to an upright support 26, such as tree 26. Height adjustment interface 18 allows neck 16 to be selectively rotated to place rim 24 at a user selectable height in relation to a desired playing surface 28. Leveling bracket 22 is rotatable about a longitudinal axis 23 of neck 16, which allows the orientation of backboard 20 and rim 24 to be adjusted to place rim 24 in a horizontal position regardless of the lean of tree 26 or other upright support. A front portion of leveling bracket 22 is also rotatable about a hinge 64, which allows the tilt of backboard 20 to be adjusted for orienting backboard 20 to a substantially vertical position.

Basketball goal system 10 can provide a properly oriented backboard 20 and rim 24 when connected to a variety of different upright supports. The upright support 26, however, does not need to be plumb for rim 24 of system 10 to be oriented in a substantially horizontal position, or for backboard 20 to be oriented in a substantially vertical position. As such, users can attach basketball goal system 10 to a variety of different upright structures, which may or may not be plumb, and can end up with a properly oriented basketball backboard 20 and rim 24.

This can provide many advantages to users of basketball goal system 10. For instance, basketball goal system 10 provides users with great flexibility in choosing a location for a basketball game. Users may attach basketball goal system 10 to almost any upright structure regardless of its vertical orientation. For example, a variety of trees, poles, or building structures may be used as a support structure. The user is therefore freer to choose a location based on other factors, such as a desired playing surface, rather than needing to find a substantially upright support structure. In addition, basketball goal system 10 may be set up in various non-conventional locations, such as along the edge of lake.

Further, being able to connect to a variety of upright structures provides great flexibility in selecting a desired stiffness for the support. For example, a user may select a smaller tree to provide a bendable support system that can absorb shocks during moderate to heavy playing conditions. In another example, a user may select a stiffer upright support, such as a telephone pole, to provide rigid support for heavier playing conditions.

Figure 2:
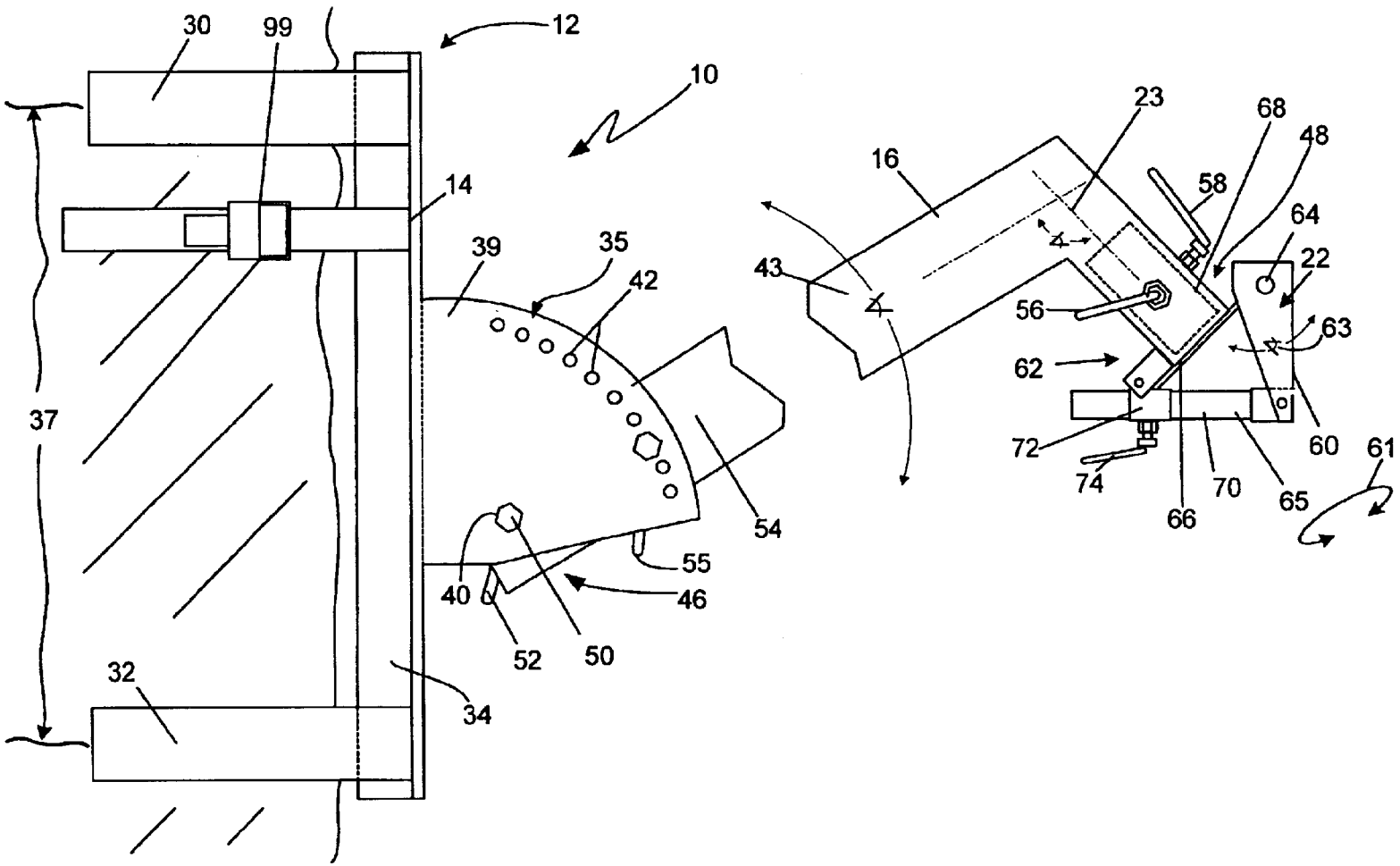
FIG. 2 is side view of the basketball goal system of FIG. 1 shown without the backboard and rim.
Figure 3:
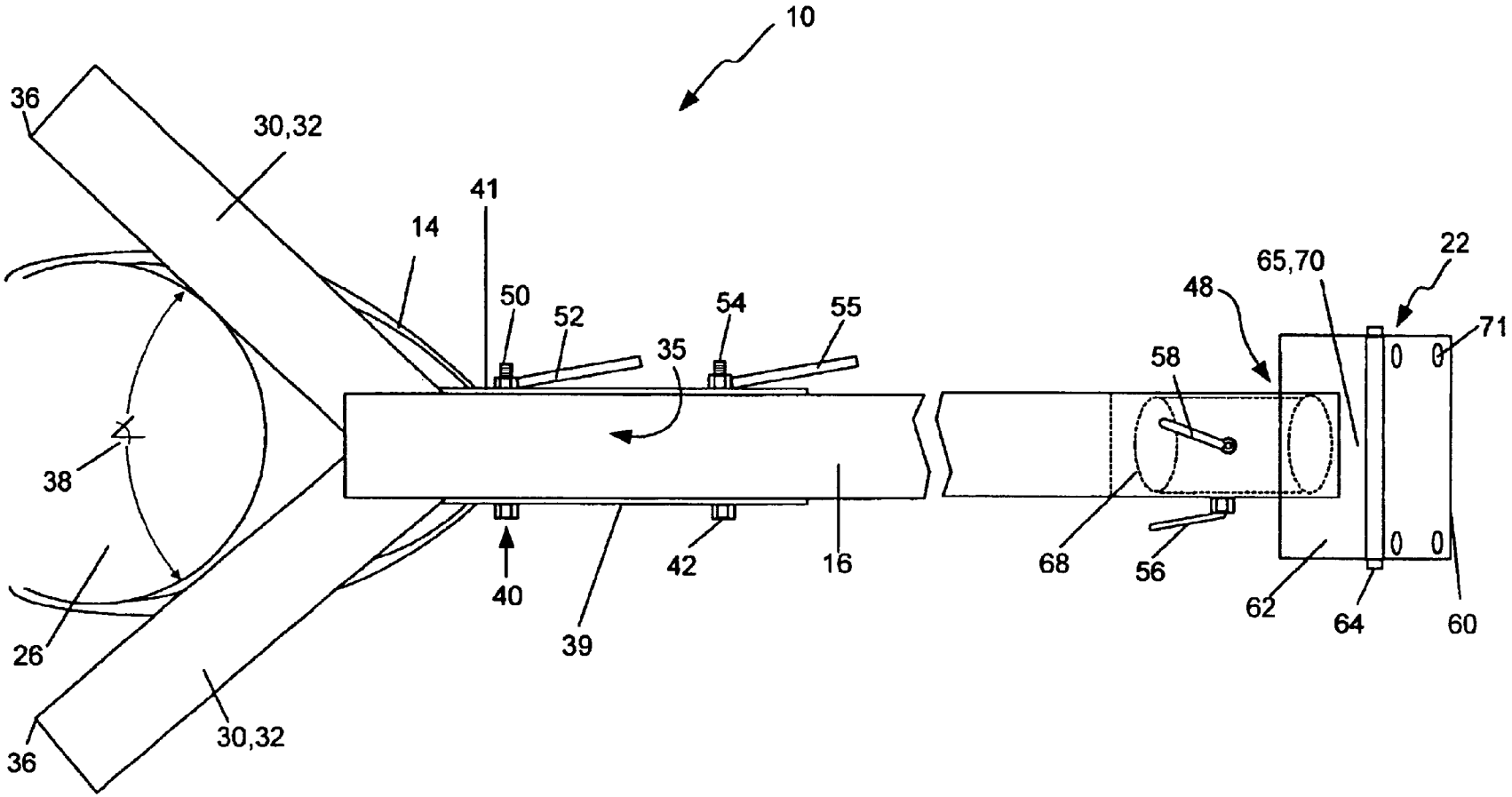
FIG. 3 is a top view of the basketball goal system of FIG. 2.
Figure 4:
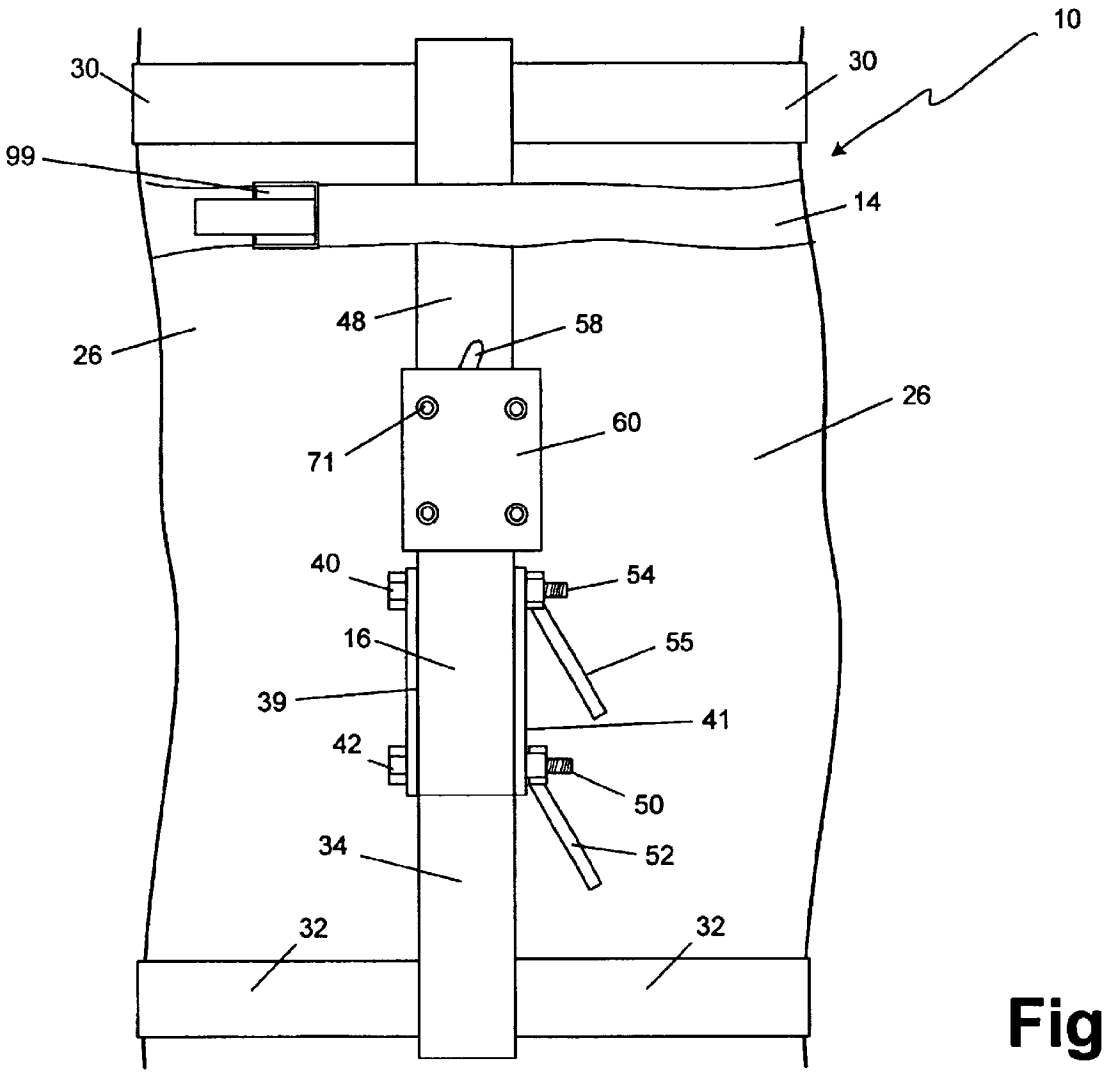
FIG. 4 is a front view of the basketball goal system of FIG. 2.

FIGS. 2–4 show the embodiment of FIG. 1 without backboard 20 and rim 24 for ease of explanation. As shown, base 12 may be formed from a first pair of angularly opposed standoffs 30 aligned with a second pair of angularly opposed standoffs 32 that are connected via bridge 34. Base 12 may be formed by welding metal rectangular tubes to form opposed standoffs 30, 32 and bridge 34. The two pairs of angularly opposed standoffs 30 and 32 are spaced a vertical distance 37 by bridge 34 to provide leverage support. For example, the vertical distance 37 between standoffs 30 and 32 is preferably within the range of two to four feet. More preferably, vertical distance 37 is within the range of 24 to 28 inches. However, other ranges may provide sufficient leverage support.

The angularly opposed standoffs 30, 32 define a gap for receiving a curved upright support, such as tree 26. The angle 38 between opposed standoffs is preferably within the range of 80 to 120 degrees to receive a wide range of trees or poles. More preferably, angle 38 is within the range of 95 to 105 degrees, and even more preferably is about 100 degrees. At such an angle, the gap between opposed standoffs 30, 32 is typically sufficient to receive a tree up to about two feet in diameter without the inner tips 36 of the standoffs biting into the tree; It is also typically sufficient to provide four points of contact along the inside of the standoffs 30, 32 against smaller poles, such as telephone poles.

The inner tips 36 of standoffs 30, 32 are substantially aligned in the same plane for abutting against a flat surface, such as an outer wall of a building. Accordingly, base 12 is adapted to connect to various types of upright structures, which may include both curved and planar surfaces. To improve contact against a flat surface, a pad (not shown) such as a metal flange may be attached to the distal end of each standoff 30, 32. The pads (not shown) may be substantially arranged in the same plane and may include a mounted mechanism for attaching to the flat surface. For example, each pad may be mounted using conventional hardware, such as bolts through the pad to permit bolted attachment to the flat support surface. In another example, the distal end of each standoff may be cut within the same plane (not shown) to facilitate mating to a flat surface.

Base 12 and other components of basketball goal system 10 may be formed using a variety of metals, plastics, or other common materials that can be assembled using known methods. For example, a lightweight and resilient material such as thin-walled steel known as electric metallic tubing (E.M.T.) may be desirable for many components. In another example, aluminium tubing or plates may be desirable for many components. Additionally, specially designed components conducive to manufacturing methods may be used. For instance, components formed via aluminium extrusion methods may be desirable. Connection and assembly methods may include welding, bolting, screwing, force fits, and other methods known in the art.

As shown in FIGS. 1–4, height adjustment interface 18 includes a pair of opposing brackets 39 and 41 welded to bridge 34 and spaced apart to form a neck-receiving channel 35. A lower portion of interface 18 includes a pair of pivot holes 40 and a series of adjustment holes 42 formed through interface 18. Pivot holes 40 permit neck 16 to be pivotally connected to base 12 via interface 18, and adjustment holes 42 permit the angular orientation of neck 16 to be adjusted and set to a selected angular position based on predefined adjustment holes 42. Accordingly, neck 16 has an angular range of motion 43 within a range of 45 to 160 degrees. Preferably, angular range of motion 43 is within a range of 60 to 120 degrees. More preferably, angular range of motion 43 is about 65 degrees. However, angular range of motion 43 may include various other ranges, and the ranges may be oriented differently with respect to base 12. As an example, at the lowest setting, neck 16 may be angled about 85 degrees from base 12, and at the highest setting, neck 16 may be angled about 20 degrees from base 12.

Neck 16 generally includes an elongated rectangular tube having a base end 46 and a backboard end 48. Base end 46 is received in neck-receiving channel 35 of interface 18 and is pivotally attached to interface 18 via bolt 50. Bolt 50 is installed through holes 40 of interface 18 and corresponding holes formed through neck 16 at base end 46. A handle 52 is attached to a nut on one end of bolt 50 to facilitate assembly and adjustment of neck 16 to interface 18. A bolt 54 is installed through one of adjustment holes 42 and a corresponding hole in neck 16 to secure neck 16 at a desired angular orientation. Handle and nut combination 55 secures bolt 54 in the desired location. By adjusting the angular orientation of neck 16, a user can modify the height of rim 24 as desired.

Backboard end 48 of neck 16 includes a first locking stud 56 and a second locking stud 58. Locking studs 56 and 58 each include a handle connected to a bolt that is threaded through a nut welded on the outside of neck 16 at backboard end 48. Locking stud 56 is installed on a lateral side of the rectangular tube forming neck 16, and locking stud 58 is installed on the top side of the rectangular tube forming neck 16. Locking studs 56 and 58 act to secure levelling bracket 22 to neck 16 in a desired orientation.

As also shown in FIGS. 1–4, levelling bracket 22 generally includes a backboard bracket 60, a neck connector 62, a hinge 64, and a tilt adjustment 65. Backboard bracket 60 includes a plurality of holes 71 formed therethrough for attaching backboard 20 and rim 24 to bracket 60. Hinge 64 pivotally connects backboard bracket 60 to neck connector 62 along a top portion of bracket 60 and connector 62. Neck connector 62 includes a plate 66 attached to hinge 64 on an upper portion, and a tilt adjustment 65 attached on an opposite lower portion.

Extending from a topside of plate 66 is a round tube 68, which is received inside backboard end 48 of neck 16 for attaching levelling bracket 22 to neck 16. Tilt adjustment 65 is attached to a bottom end of plate 66 and to a bottom portion of backboard bracket 60. Tilt adjustment 65 includes a slide bar 70 pivotally connected to backboard bracket 60 that extents though a slide bracket 72 pivotally connected to plate 66. Slide bar 70 can translate within slide bracket 72, and thereby rotate backboard bracket 60 toward and from plate 66. A slide lock stud 74 is threaded through slide bracket 72 to lock slide bar 70 in a desired position.

Levelling bracket 22 allows a user to tilt and angularly rotate backboard bracket 60, and a backboard 20 and rim 24 attached thereto, with respect to neck 16. For example, backboard bracket 60 has an angular range of motion 61 of 360 degrees about longitudinal axis 23 of neck 16. Although, it may have a smaller angular range of motion. In addition, backboard bracket 60 has an angular range of motion 63 within the range of 40 to 165 degrees about hinge 64. Preferably, angular range of motion 63 is within the range of 55 to 125 degrees, and more preferably is about 70 degrees. Although angular range of motion 63 may include other ranges, it is preferably larger than neck angular range of motion 43, thereby allowing the tilt of backboard bracket to adjust to the height adjustment of neck 16. For instance, neck angular range of motion 43 may be about 65 degrees, and backboard bracket range of motion 63 may be about 70 degrees. As such, backboard 20 and rim 24, which are attached to backboard bracket 60, may be tilted and rotated as desired by the user with respect to neck 16.

Because round tube 68 fits within a square cavity of neck 16, levelling bracket 22 may be rotated about longitudinal axis 23 of neck 16. A user may lock-in a desired rotational orientation (typically to make rim 24 substantially horizontal) by turning locking studs 56 and 58 until they make an interference contact with round tube 68. In an alternate embodiment, the round tube and square bracket arrangement may be reversed. For example, backboard end 48 of neck 16 may include a round tube, and levelling bracket 22 may include a square bracket adapted to receive the round tube of neck 16 within it. As such, the locking studs would be attached to the square bracket on the levelling bracket 22 for retaining the desired configuration. A safety connector (not shown), such as a cable may be used to attach neck 16 to backboard 20 or levelling bracket 22, and to thereby protect users in the event locking studs 56 and 58 are not sufficiently tightened.

As shown in FIG. 1, basketball goal system 10 may be mounted to an upright support such as tree 26. The design of basketball goal system 10 allows the process of mounting it to an upright support to be relatively quick and easy. A user may store basketball goal system 10 in a semi-assembled state in which levelling bracket 22 is detached from neck 16, and neck 16 is detached from base 12. Accordingly, backboard 20 and rim 24 are stored attached to levelling bracket 22 as a first unit, and neck 16 and base 12 are stored as separate units. The attachment strap 14 could be wrapped around any of the units or stored separately. A user may thus transport basketball goal system 10 as three or more units using a minivan, pickup truck, or other vehicle. Neck 16 is around 6 feet in length, which allows it to fit within most vehicles. Further, neck 16 preferably has length within a range of 5 to 15 feet to accommodate different types of basketball goal systems having different amounts of height adjustability; although, the length of neck 16 may be within different ranges.

To mount basketball goal system 10 to an upright support 26, the user places base 12 against the upright support 26 at a desired height and secures base 12 using attachment strap 14. Attachment strap 14 is preferably, but need not be a ratcheting type tie-down strap, which permits the user to tightly cinch the base 12 against upright support 26 using ratcheting mechanism 99. Attachment strap 14 may include a variety of different attachment devices, such as a non-ratcheting tie-down strap, a steel cable, or a chain with a binding system. In this embodiment, only one attachment strap 14 is shown connecting base 12 to upright support 26; however, a plurality of attachment straps may be used to provide further support. This may be desirable if base 12 is attached to a substantially planar upright support, such as a support column of a two-car garage. In such a scenario, the inner tips 36 of standoffs 30, 32 make contact with the substantially planar upright support. Alternatively, pads (not shown) may be provided with an attachment mechanism, such as bolts, for attaching to a planar upright support. When attached to a planar upright support, angular regions 38 between standoffs 30, 32 are not able to provide lateral support as in the case of a curved upright support (e.g. tree or pole). As such, multiple attachment straps may be desirable. In the case of a curved upright support, the upright support 26 is received into the angular region 38 between each pair of standoffs 30, 32. Attachment strap 14 may be attached just below the upper standoff 30 to circumscribe the combination.

After securing the base 12 to upright support 26, the user may attached levelling bracket 22 to the backboard end 48 of neck 16. The user may then orient backboard 20 and rim 24 to ensure backboard 20 is substantially vertical, and that rim 24 is substantially horizontal. This may be done by rotating levelling bracket 22 about neck axis 23 to a desired orientation, and rotating backboard bracket 60 about hinge 64 to a desired tilt orientation. The orientation of backboard 20 and rim 24 may be set by securing lock studs 56, 58 and 74. The user may then rotate neck 16 upward to place rim 24 at a desired height above playing surface 28. The desired height may be secured by placing bolt 54 through an appropriate set of adjustment holes 42 and locking it down using handle 56 attached to a corresponding nut. If necessary, the user may make further adjustments by rotating neck 16 downward, adjusting levelling bracket 22 as desired, and rotating neck 16 upward to desired position. The user may use a measuring tape attached to rim 24 to fine-tune the rim height.

Figure 5:
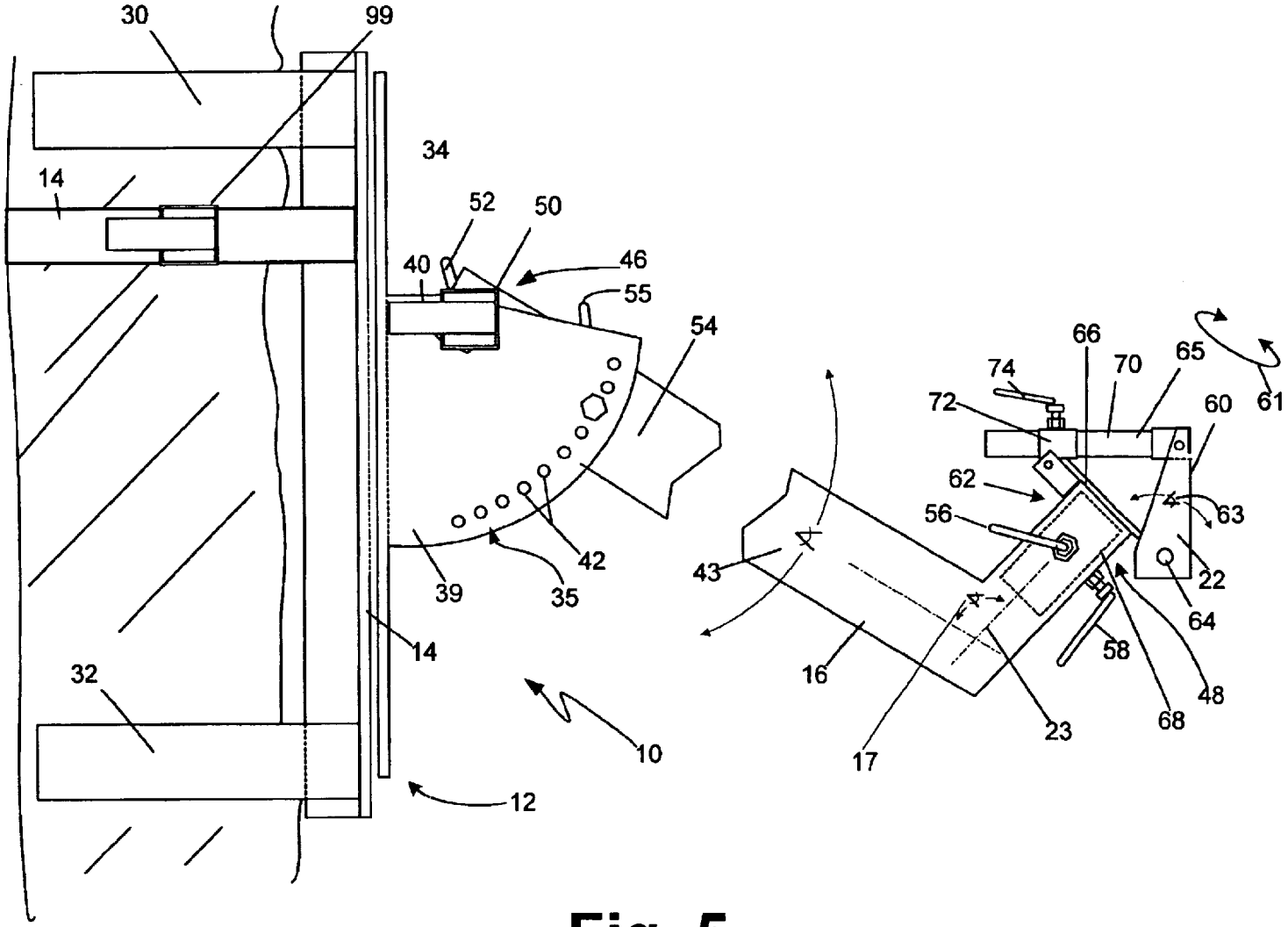
FIG. 5 is side view of the basketball goal system of FIG. 1 shown installed in an inverted configuration without the backboard and rim.

If the user desires to semi-permanently install the basketball goal system 10 on an upright structure, and desires to place neck 16 out of the way of players, he may install it in an inverted configuration, as shown in FIG. 5. This may also be desirable for setting up basketball goal system 10 at a low height for children to use. As such, backboard 20 may be kept closer to base 12, rather than far from base 12 as in the non-inverted configuration.

To install basketball goal system 10 in an inverted configuration, the user may use a ladder to assist in attaching base 12 to an upright support in a manner inverted from the previously discussed installation. Thus, neck 16 will rotate upward away from the upright support. Once the base 12 is mounted, the user may install the backboard 20, rim 24 and levelling bracket 22 as previously discussed. The backboard 20 and backboard bracket 60 may be rotated about 180 degrees about neck axis 23, depending on the lean upright support 26, to account for inversion of the base. Alternatively, backboard 20 may be attached to backboard bracket 60 in a position 180 degrees from the non-inverted configuration, to account for inversion of the base. In any event, backboard bracket 60 and attached backboard 20 can be oriented into a vertical position. In the inverted configuration, neck 16 is above the height of rim 24, and is thus out of the way of players. This may be handy in a driveway environment or similar location where it is undesirable to have portions of basketball goal structure 10 below the height of backboard 20.

Figure 6:
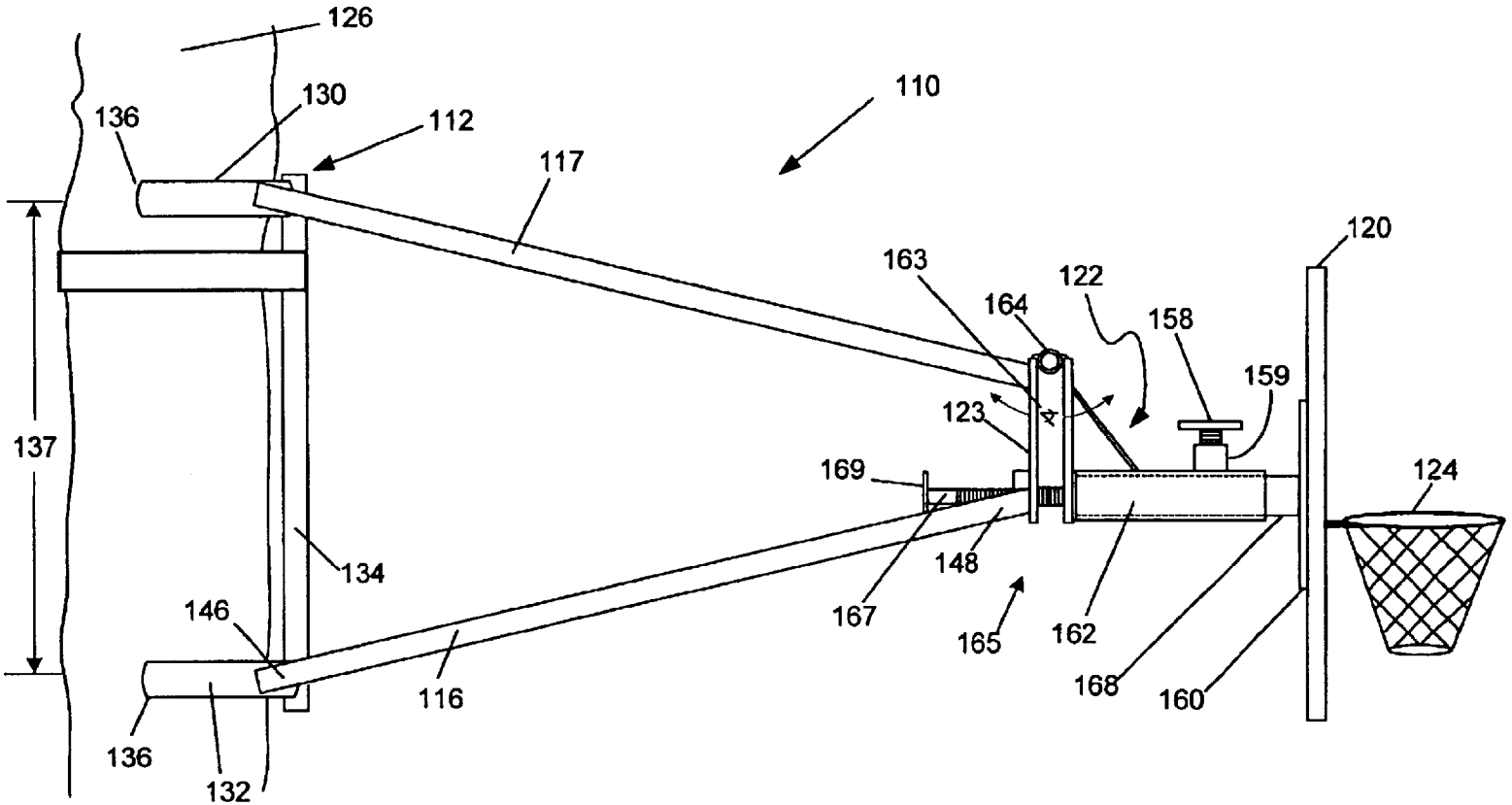
FIG. 6 is a side view of a basketball goal system according to another embodiment of the invention, which is shown attached to an upright structure, such as a tree or a pole.
Figure 7:
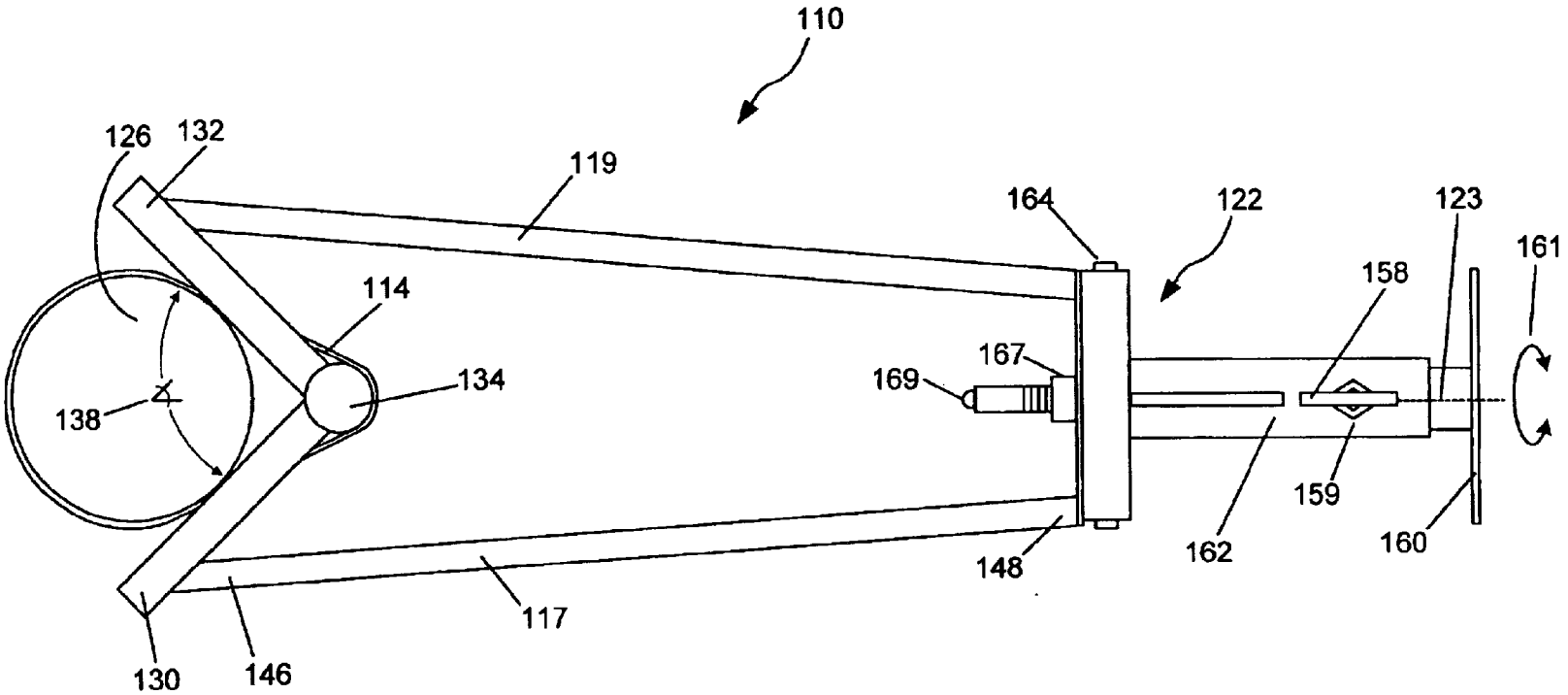
FIG. 7 is a top view of the basketball goal system of FIG. 6 shown without the backboard and rim.
Figure 8:
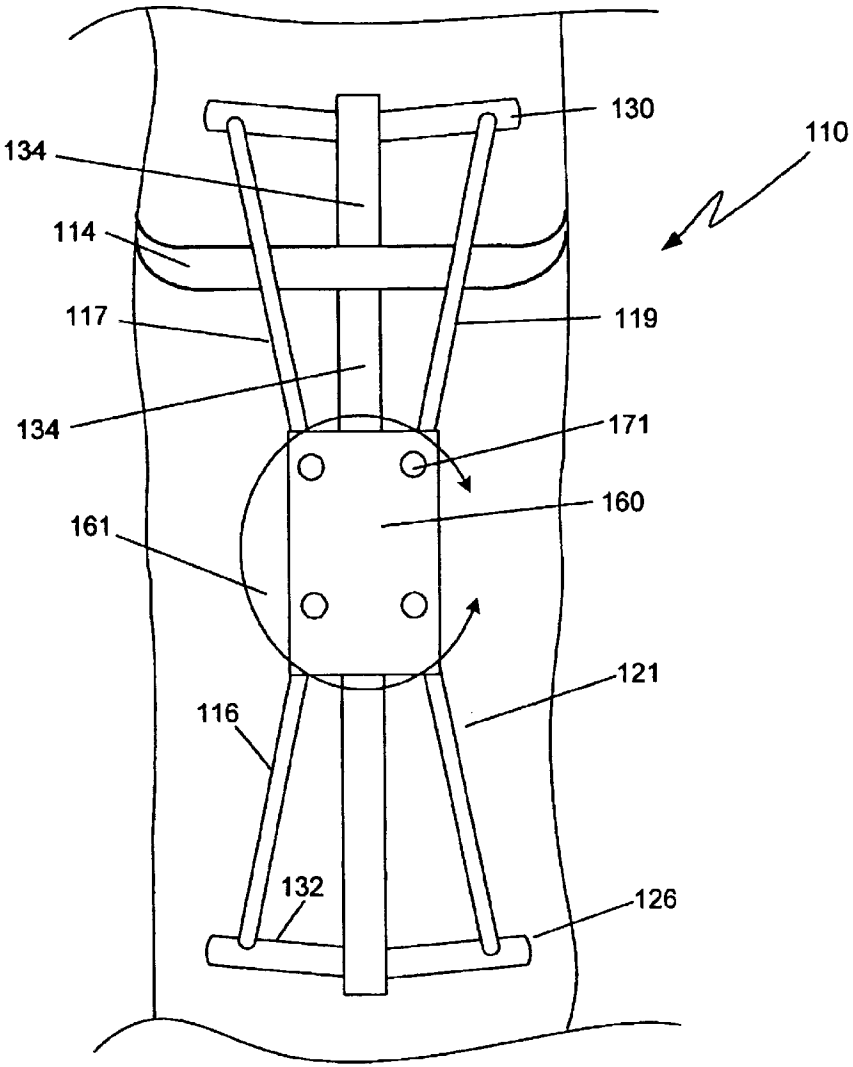
FIG. 8 is a front view of the basketball goal system of FIG. 7.

Referring now to FIGS. 6–8, a basketball goal system 110 according to another embodiment of the invention is generally shown. Basketball goal system 110 includes a base 112, an attachment strap 114, four neck supports 116, 117, 119 and 121, a backboard 120, a leveling bracket 122, and a rim 124 attached to backboard 120. As shown in FIG. 6, basketball goal system 110 may be attached to an upright support 126, such as a pole, tree or column. Leveling bracket 122 rotatably connects backboard 120 to neck supports 116, 117, 119 and 121. Leveling bracket 122 also allows the orientation of a backboard bracket 160, and thereby backboard 120 and rim 124, to be adjusted to place rim 124 in a vertical position regardless of the lean of upright support 126. Further, leveling bracket 122 allows the tilt of backboard bracket 160, and thereby backboard 120, to be adjusted for orienting backboard 120 to a substantially vertical position.

Base 112 may be formed from a first pair of angularly opposed standoffs 130 aligned with a second pair of angularly opposed standoffs 132 that are connected via bridge 134. As with basketball goal system 10, the two pairs of angularly opposed standoffs 130 and 132 are spaced a vertical distance 137 by bridge 134 to provide leverage support, which may be within the range of 2 to 4 feet. The angularly opposed standoffs 130, 132 define a gap for receiving a curved upright support, such as tree 126. The angle 138 between opposed standoffs may be, for example, around 100 degrees to receive moderate size trees or poles, or within various ranges as discussed with backboard goal system 10. The inner tips 136 of standoffs 130, 132 are substantially aligned in the same plane for abutting against a flat surface, such as an outer wall of a building. Accordingly, base 112 is adapted to connect to various types of upright structures, which may include both curved and planar surfaces. To improve contact against a flat surface, a pad (not shown) such as a metal flange may be attached to the distal end of each standoff 130, 132. As with basketball goal system 10, base 112 and other components of basketball goal system 10 may be formed using a variety of metals, plastics, or other common materials that can be assembled using known methods.

Neck supports 116, 117, 119 and 121 generally include elongated tubes that each have a base end 146 and an opposing backboard end 148. Each base end 146 is welded to a corresponding one of standoffs 130, 132, and each backboard end 148 is welded to a rear plate 123 of levelling bracket 122.

As shown in FIGS. 6–8, levelling bracket 122 generally includes a backboard bracket 160, a backboard connector 162, a hinge 164, a rear plate 123, and a tilt adjustment 165. Backboard bracket 160 includes a plurality of holes 171 formed therethrough for attaching backboard 120 and rim 124 to bracket 160. Hinge 164 pivotally connects rear plate 123 to backboard connector 162. Backboard connector 162 includes a round tube 168 extending rearward from backboard bracket 160, a square tube 162, and a lock stud 158. Round tube 168 slides into square tube 162 and is locked into place by turning lock stud 158 to engage round tube 168. Lock stud 158 is a threaded stud that is threaded through the wall of square tube 162 via a lock nut 159 welded to an outer wall of square tube 162.

Because round tube 168 fits within square tube 162, backboard bracket 160 may be rotated in relation to base 112. For example, backboard bracket 160 may be rotated in the direction 61 shown in FIG. 6 about a longitudinal axis of square tube 162 approximately 360 degrees. As such, backboard 120 and rim 124 attached to backboard bracket 160 may be completely rotated as desired about the longitudinal axis 123 of square tube 162. Thus, angular rotation 161 about longitudinal axis 123 is about 360 degrees; although, a smaller angular rotation may be provided. Typically, a user will use such angular rotatability to ensure that rim 124 is oriented substantially horizontal.

Tilt adjustment 165 works in concert with hinge 164 to adjust the angular relation between rear plate 123 and backboard connector 162. Tilt adjustment 165 includes a nut 167 welded to rear plate 123 through which a tilt stud 169 is threaded. Tilt stud 169 extends from nut 167 through rear plate 123 until it makes contact with a rear portion of backboard connector 162. Rear plate 123 rests against tilt stud 169 and is not attached to tilt stud 169, which allows rear plate 123 to bounce in response to shocks. Such a design provides additional resiliency to basketball goal system 110 for absorbing shocks. Tilt adjustment 165 permits the angular relation of backboard connector 162 to be adjusted by turning tilt stud 169 into or out of nut 167. Backboard connector 162 thus rotates about hinge 164, which permits attached backboard 120 to have an angular range of motion 163 about hinge 164. As an example, angular range of motion 163 may be about 65 degrees; although, other ranges may provide sufficient flexibility for adjusting the tilt of backboard connector 162. Accordingly, the tilt of backboard 120 may be adjusted as desired.

As shown in FIGS. 6–8, basketball goal system 110 may be mounted to an upright support 126. The design of basketball goal system 110 allows the process of mounting it to an upright support 126 to be relatively quick and easy. A user may store basketball goal system 110 in a semi-assembled state in which backboard bracket 160 is detached from backboard connector 162. Accordingly, backboard 120 and rim 124 are attached to backboard bracket 160 as a first unit, and base 112, neck supports 116, 117, 119 and 121, and levelling bracket 122 are attached as a second unit. The attachment strap 114 could be wrapped around either unit or stored separately. A user may thus transport basketball goal system 110 as two or more units using minivan, pickup truck, or other vehicle.

To mount basketball goal system 110 to an upright support 26, the user places base 112 against the upright support 126 at a desired height and secures base 112 using attachment strap 114. After securing the base 112 to upright support 126, the user may attach backboard bracket 160 to backboard connector 162. The orientation of backboard 120 and rim 124 may be set by rotating backboard 120 to a desired orientation and securing lock stud 158. The user may then adjust the tilt of backboard 120 by rotating tilt stud 169 inward or outward.

Figure 9:
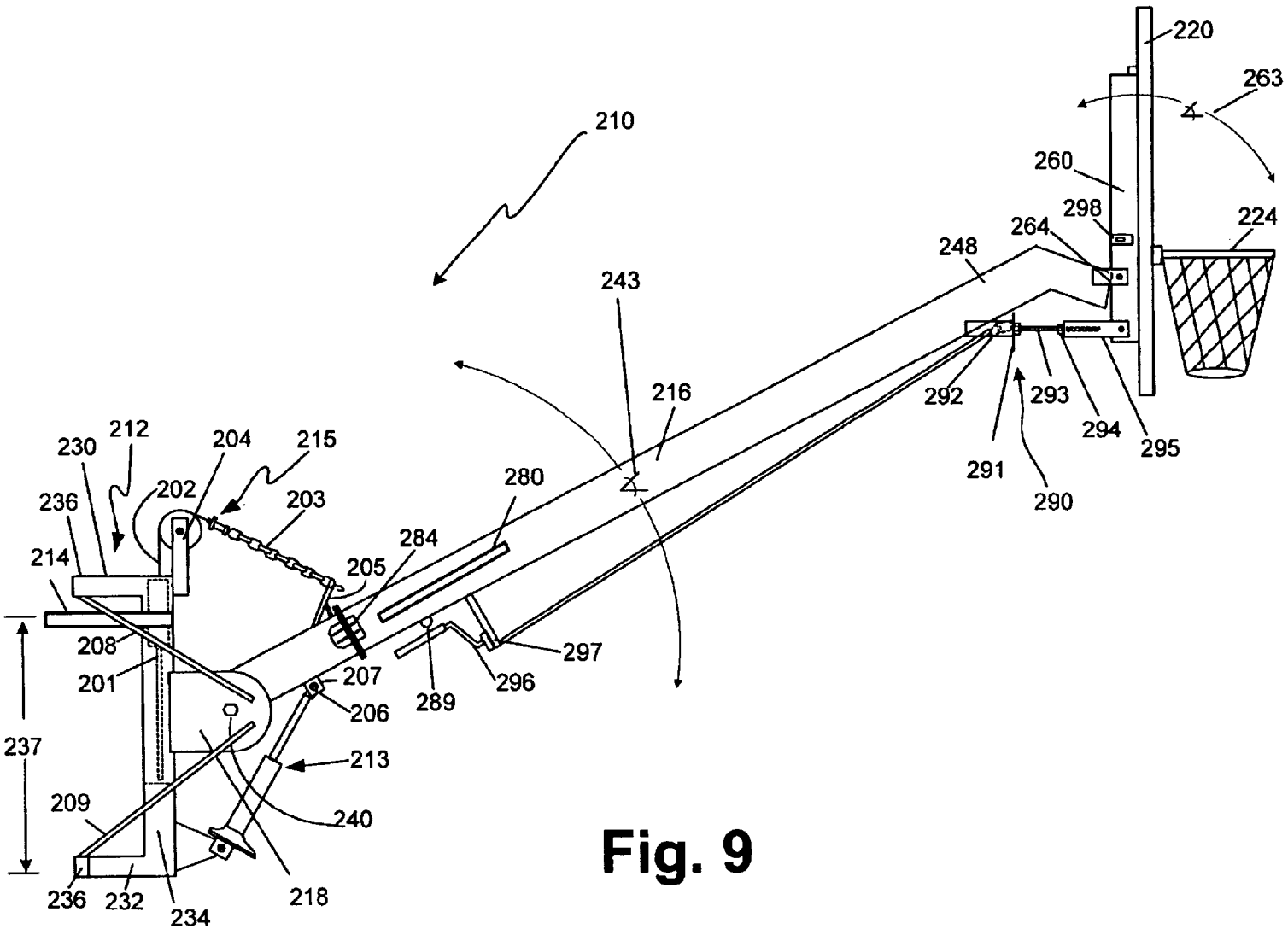
FIG. 9 is a side view of a basketball goal system according to a further embodiment of the invention.
Figure 10:
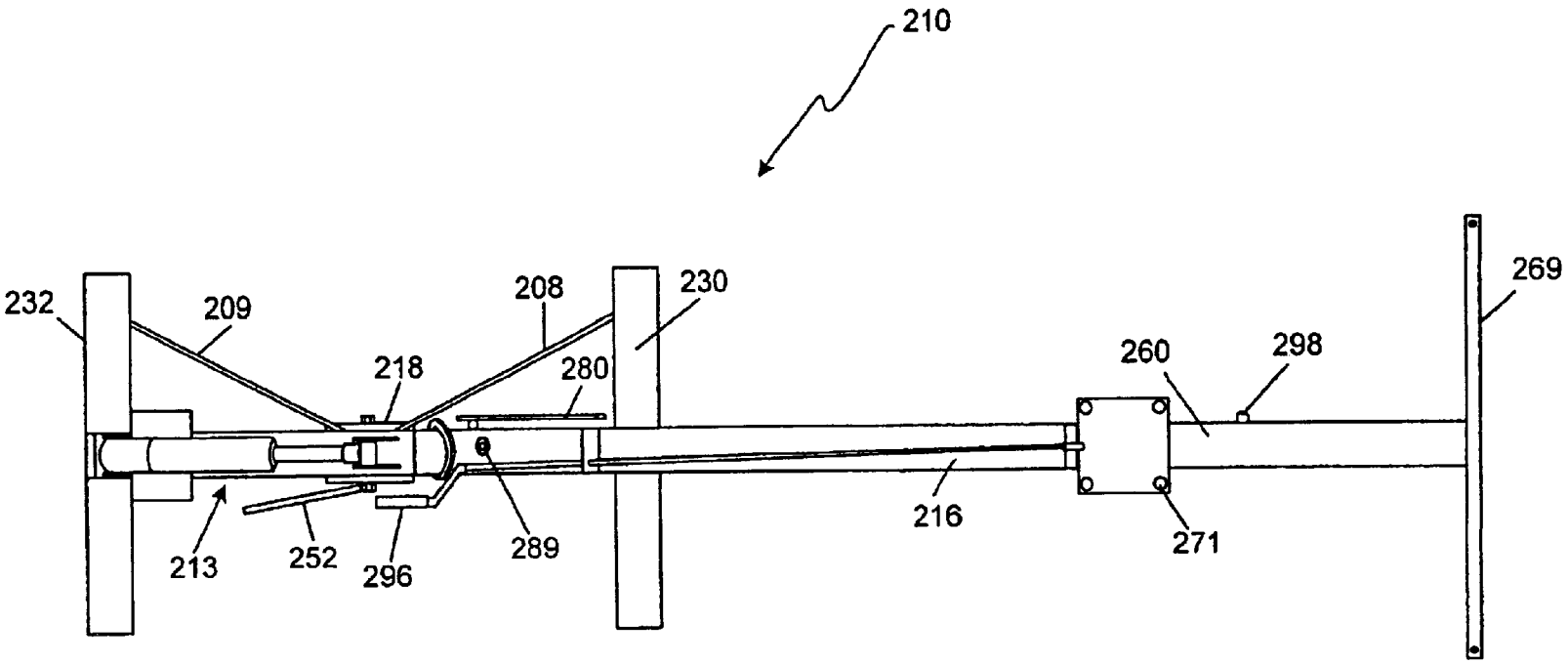
FIG. 10 is a front view of the basketball goal system of FIG. 9 shown without the backboard and rim.
Figure 11:
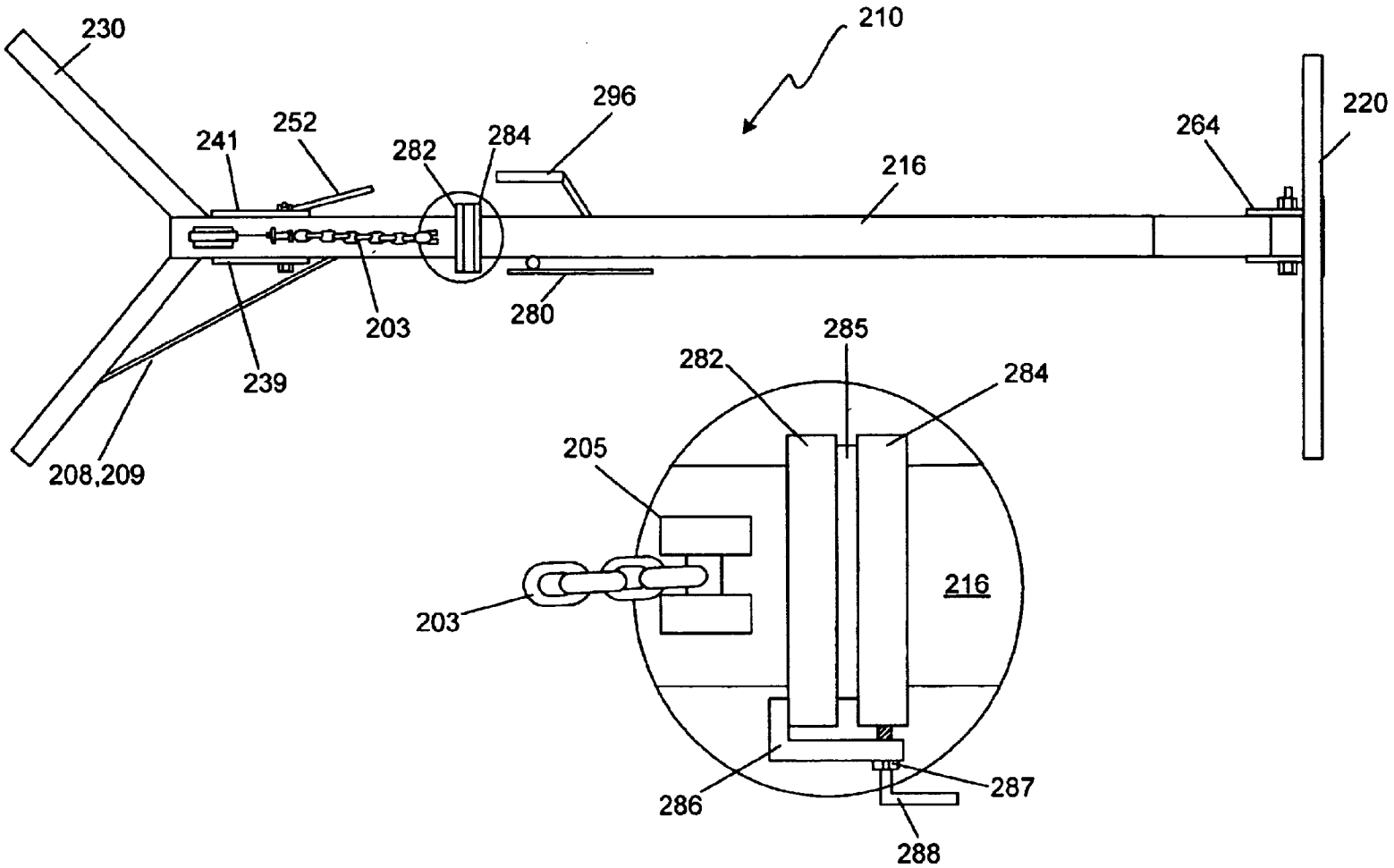
FIG. 11 is a top view of the basketball goal system of FIG. 10.

Referring now to FIGS. 9–11, a basketball goal system 210 is generally shown according to a further embodiment of the invention. Basketball goal system 210 generally includes a base 212, an attachment strap 214, a neck 216, a neck interface 218 pivotally connecting base 212 to neck 216, a lift 213, a shock-absorbing mechanism 215, a backboard 220 attached to a backboard bracket 260, a hinge 264 connecting backboard bracket 260 to neck 216, a leveling adjuster 290, and a rim 224. As with the previously discussed embodiments, basketball goal system 210 may be attached to an upright support. Lift 213 assists the user in selectively rotating neck 216 to place rim 224 at a desired height in relation to a playing surface. Leveling adjuster 290 allows the tilt of backboard 220 and rim 224 to be adjusted to orient backboard 220 to a substantially vertical position. A portion of neck 216 is rotatable along its longitudinal axis to allow rim 224 to be oriented to a substantially horizontal position. Shock-absorbing mechanism 215 allows neck 216 to move downward in response to a severe shock, and preferably returns neck 216 to its original pre-shock position.

As with systems 10 and 110, basketball goal system 210 can provide a properly oriented backboard 220 and rim 224 when connected to a variety of different upright supports. The upright support to which it is attached, however, does not need to be plumb for rim 224 of system 210 to be oriented in a substantially horizontal position, or for backboard 220 to be oriented in a substantially vertical position. As such, users can attach basketball goal system 210 to a variety of different upright structures, which may or may not be plumb, and can end up with a properly oriented basketball backboard 220 and rim 224 in relation to the desired playing surface.

As discussed with previously described embodiments, base 212 may be formed from a first pair of angularly opposed standoffs 230 aligned with a second pair of angularly opposed standoffs 232 that are connected via bridge 234. The two pairs of angularly opposed standoffs 230 and 232 are spaced a vertical distance 237 by bridge 234 to provide leverage support. For example, the vertical distance 237 between standoffs 230 and 232 is preferably within the range of two to four feet. More preferably, vertical distance 237 is within the range of 24 to 28 inches. However, other ranges may provide sufficient leverage support.

The angularly opposed standoffs 230, 232 define a gap for receiving a curved upright support. The angle 238 between opposed standoffs is preferably within the range of 80 to 120 degrees. More preferably, angle 238 is within the range of 95 to 105 degrees, and even more preferably is about 100 degrees. At such an angle, the gap between opposed standoffs 230, 232 is typically sufficient to receive a tree up to about two feet in diameter without the inner tips 236 of the standoffs biting into an upright support, such as a tree; It is also typically sufficient to provide four points of contact along the inside of the standoffs 30, 32 against smaller poles, such as telephone poles.

The inner tips 236 are substantially aligned in the same plane for abutting against a flat surface, such as an outer wall of a building. Accordingly, base 212 is adapted to connect to various types of upright structures, which may include both curved and planar surfaces. To improve contact against a flat surface, a pad (not shown) such as a metal flange may be attached to the distal end of each standoff 230, 232. The pads (not shown) may be substantially arranged in the same plane and may include a mounted mechanism for attaching to the flat surface. For example, each pad may be mounted using conventional hardware, such as bolts through the pad to permit bolted attachment to the flat support surface. In another example, the distal end of each standoff may be cut within the same plane (not shown) to facilitate mating to a flat surface. Thus, base 212 may attach to curved or flat upright supports.

Base 212 also includes a pair of lateral supports 208 and 209 for providing lateral support to system 210. The upper lateral support 208 is attached to upper standoff 230 at a distal region 236 and to neck interface 218 on the other end. Lower lateral support 209 likewise connects a distal region 236 of lower standoff 232 to neck interface 218. Base 212 and other components of basketball goal system 210 may be formed using a variety of metals, plastics, or other common materials that can be assembled using known methods.

As shown in FIGS. 9–11, neck interface 218 includes a pair of opposing brackets 239 and 241 welded to bridge 234 and spaced apart to form a neck-receiving channel 235. A lower portion of interface 218 includes a pair of pivot holes 240 formed through interface 218. Pivot holes 240 permit neck 216 to be pivotally connected to base 212 via interface 218.

Neck 216 generally includes an elongated rectangular tube having a base end 246 and a backboard end 248. Base end 246 is received in neck receiving area 235 of interface 218 and is pivotally attached to interface 218 via bolt 250. Bolt 250 is installed through holes 240 of interface 218 and corresponding holes (not shown) formed through neck 216 at base end 246. A handle 252 is attached to a nut on one end of bolt 250 to facilitate assembly of neck 216 to interface 218.

The pivotal connection between base 212 and neck 216 allows neck 216 to have an angular range of motion 243, which is within a range of 45 to 160 degrees. Preferably, angular range of motion 243 is within a range of 60 to 120 degrees. More preferably, angular range of motion 243 is about 65 degrees. However, angular range of motion 243 may include various other ranges that may be oriented differently with respect to base 12. As an example, at the lowest setting, neck 216 may be angled about 85 degrees from base 212, and at the highest setting, neck 16 may be angled about 20 degrees from base 212. The angular range of motion 243 may be almost any range; however, a range of about 65 degrees will accommodate the lean of most upright structures 226. Further, removal of lift 213 may permit increased ranges of motion.

Lift 213 is disposed between base end 246 of neck 216 and a lower portion of base 212 and assists users in raising and lowering neck 216 as desired to adjust the height of rim 224 above the playing surface. Lift 213 may include a variety of assists, such as a hydraulic jack or a screw jack. As shown, lift 213 is preferably removably connected to neck 216 via a removable pin 206 attached through a hole (not shown) formed in a bracket 207 on the lower side of neck 216.

As also shown in FIGS. 9–11, a shock-absorbing mechanism 215 is disposed on base 212. Shock-absorbing mechanism 215 avoids failure of the system or components, such as a bent rim, by absorbing shocks that may occur during extreme play. Further, shock-absorbing mechanism 215 may be adapted to dampen shocks to the system and to return the system to the pre-shock orientation. For example, with lift 213 detached, shock-absorbing mechanism 215 may permit neck 216 to rotate downward when rim 224 receives a severe shock. For instance, a 200-pound player may slam a ball through rim 224 and hang onto rim 224 afterward. When the shock is received, neck 216 can rotate downward in a controlled arc according to shock-absorbing mechanism 215. When the shock is removed (e.g., the player releases rim 224), shock-absorbing mechanism 215 may be designed to reverse the rotation of neck 216 and return it to its pre-shock orientation.

In the embodiment shown in FIGS. 9–11, shock-absorbing mechanism 215 includes a gas cylinder 201, a cable 202 connected to a chain 203, a pulley 204, and a clevis 205. Gas cylinder 201 is disposed within bridge 234 and is pinned at an upper end to bridge 234. The opposing longitudinal lower end of gas cylinder 201 is attached to cable 202, which may include a steel cable. Cable 202 is partially oriented around a pulley 204, which is attached to an upper portion of bridge 234. The cable 202 attaches to a chain 203, which extends to a clevis 205 welded on an upper side of neck 216.

By connecting chain 203 to neck 216 via clevis 205, the length of chain 203 may be adjusted in accordance with the angular orientation of neck 216. For example, when neck 216 is placed in a desired orientation, chain 203 may be connected to clevis 205 in a taut arrangement. As such, when lift 213 is disconnected from neck 216, shock-absorbing mechanism 215 maintains the desired angular orientation of neck 216, and thus the desired height of rim 224. When a downward shock is received, gas shock 201 dampens the shock as it is contracted while neck 216 moves downward. When the shock is removed, gas shock 201 extends and thereby returns neck 216 to the pre-shock orientation. Thus, rim 224, backboard 220 and neck 216 move downward as a unit to accommodate the shock, and move upward to their pre-shock location after the shock load is removed.

As with the previously described embodiments, basketball goal system 210 allows rim 224 to be moved as desired to place it in a substantially horizontal orientation. To facilitate such adjustability, backboard end 248 is rotatable about the longitudinal axis of neck 216 in relation to base end 246. A user may rotate backboard end 248 in relation to base end 246 using axis rotation handle 280, which is foldably attached to the side of neck 246. Neck 216 is rotatable via a pair of opposing neck rotation plates 282 and 284.

Neck rotation plates 282 and 284 are disposed perpendicular to the longitudinal axis of neck 216. They are rotatably attached via a bolt (not shown) that pins neck rotation plates 282 and 284 to each other along the longitudinal axis of neck 216. Preferably, as shown in FIG. 11, a slip disk 285 is installed between neck rotation plates 282 and 284 to reduce friction and thereby improve rotation between the plates. To lock-in a desired neck rotation, an angle clip 286 is welded to one of the neck rotation plates 282. A jam nut 287 is welded to angle clip 286 for receiving a set screw 288. Setscrew 288 can be threaded through jam nut 287 and angle clip 286 to interfere with neck rotation plate 284 in a locked configuration. As shown in FIGS. 9 and 10, a level 289 may be attached to the underside of neck 216 to assist a user in placing rim 224 in a horizontal orientation.

In addition to neck adjustability, basketball goal system 210 further allows backboard 220 to be moved as desired to place it in a vertical orientation. Accordingly, the tilt of backboard 220 is adjustable. Backboard 220 is attached to backboard bracket 260 via bolts (bolts) installed through mounting holes 271. Backboard bracket 260 may also include an upper support 269 for attaching to an upper portion of backboard 220 to provide additional support. As shown in FIGS. 9–11, backboard bracket 260 is connected to neck 216 via hinge 264, which allows backboard 220 to be tilted. To control and adjust the tilt, a levelling adjuster 290 is attached to neck 216 that connects to a bottom portion of backboard 220.

Levelling adjuster 290 includes a clevis 291 attached to backboard end 248 of neck 216, a universal joint 292, an tilt adjustment stud 293, an tilt adjustment nut 294, a channel member 295, a tilt adjustment handle 296, and a tilt handle bracket 297. To facilitate placing backboard 220 in a substantially vertical orientation, tilt adjustment handle 296 is located on the underside of neck 216 at a lower portion of neck 216. Tilt adjustment handle 296 is connected to neck 216 via tilt handle bracket 297, which is welded to the underside of neck 216. Tilt adjustment handle 296 extends to backboard end 248 of neck 216, and attaches to universal joint 292. Universal joint 292 is connected to neck 216 via clevis 291, which is welded to the underside of backboard end 248 of neck 216. Universal joint 292 is connected to tilt adjustment stud 293, which is threaded through tilt adjustment nut 294. Tilt adjustment nut 294 is connected to channel member 295, which is pinned to a lower portion of backboard bracket 260.

Turning tilt adjustment handle 296 threads tilt adjustment stud 293 into or out of tilt adjustment nut 294. Consequently, the bottom portion of backboard 220 is correspondingly moved toward or away from clevis 291, which adjusts the tilt of backboard 220. As such, backboard bracket 260 and backboard 220 have an angular range of motion 263. Preferably, angular range of motion 263 is within the range of 55 to 125 degrees, and more preferably is about 70 degrees. Although angular range of motion 263 may include other ranges, it is preferably larger than neck angular range of motion 243, thereby allowing the tilt of backboard bracket to adjust to the height adjustment of neck 216. For instance, neck angular range of motion 243 may be about 65 degrees, and backboard interface range of motion 263 may be about 70 degrees. As such, backboard 220 and rim 224, which are attached to backboard bracket 260, may be tilted as desired by the user with respect to neck 216. A level 298 may be attached to an edge of backboard bracket 260, which assists the user in orienting backboard 220 in a vertical position.

Basketball goal system 210 is designed to be quickly and easily installed by the user, and to be easily adjusted as needed. A user may store basketball goal system 210 in a semi-assembled state in which backboard 220 is detached from backboard bracket 20 and neck 216 and base 212 are stored as separate units. Accordingly, backboard 220 and rim 224 may be transported as a first unit, and neck 216 and base 212 may be transported as separate units. The attachment strap 214 could be wrapped around any of the units or stored separately. A user may thus transport basketball goal system 210 as three or more units using a minivan, pickup truck, or other vehicle. Basketball goal system 210 may also be transported as an assembled unit, or in other combinations of units. In one embodiment, neck 216 is around 6 feet in length, which allows it to fit within many vehicles in a semi-assembled state. Further, neck 216 preferably has length within a range of 5 to 15 feet to accommodate different types of basketball goal systems having different amounts of height adjustability; although, the length of neck 216 may be within different ranges.

To mount basketball goal system 210 to an upright support, the user places base 212 against the upright support at a desired height and secures base 212 using attachment strap 214. After securing base 212 to an upright support, the user may attach backboard 220 to backboard bracket 260. The user may then rotate neck 216 upward sufficiently to install lift 213. Once lift 213 is installed, the user can raise or lower neck 216 to a desired height using lift 213. The user may then adjust the orientation of backboard 220 and rim 224. Rim 224 may be adjusted to a horizontal orientation, or another desired orientation, by longitudinally rotating neck 216. This may be done via movement of axis rotation handle 280, and locked-in via jam nut 287. The user may adjust the tilt of backboard 220 to place it in a vertical orientation, or another desired orientation, via adjustment of levelling adjuster 290. To use the shock-absorbing feature of system 210, the user may connect chain 203 to clevis 205, and disconnect lift 213 from neck 216. Lift 213 should be compressed, rotated downward, or removed from system 210 to avoid interference with neck 216 during shock absorption.

Figure 12:
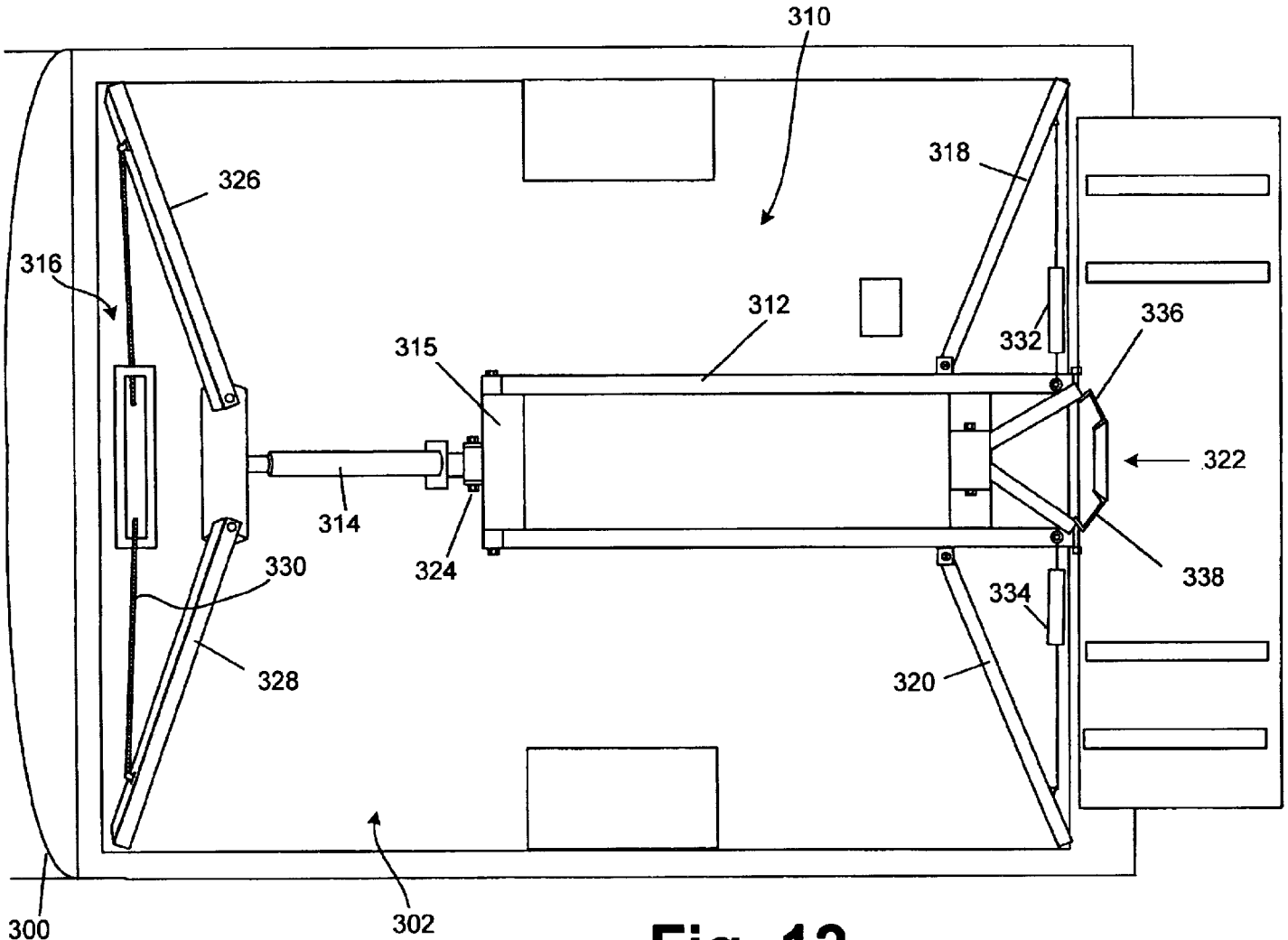
FIG. 12 is a top view of a vehicle-mounted support to which portable basketball goal systems may be attached, which is shown installed in the bed of truck according to an embodiment of the invention.
Figure 13:
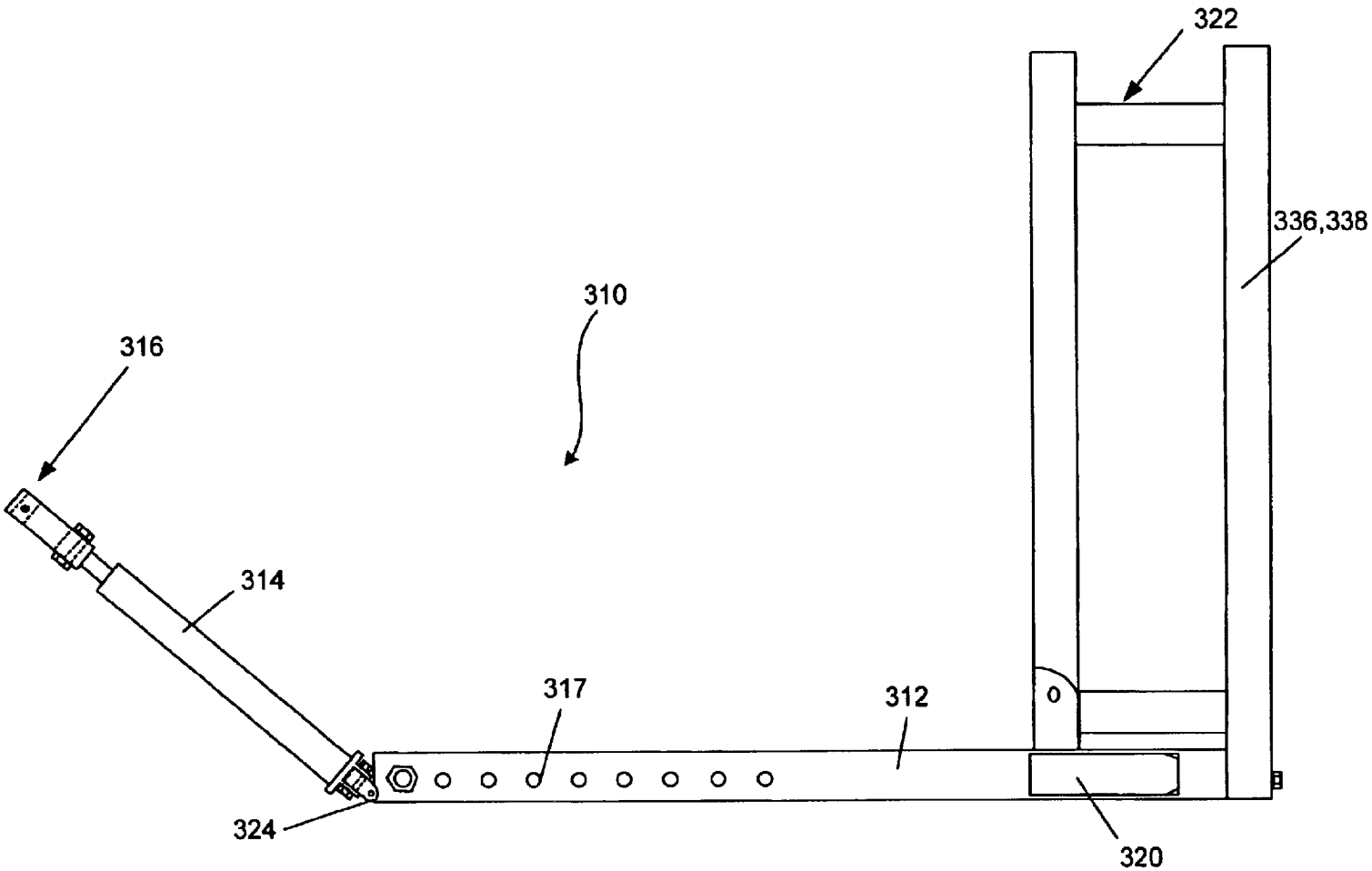
FIG. 13 is a side view of the vehicle-mounted support of FIG. 12 shown without the truck.
Figure 14:
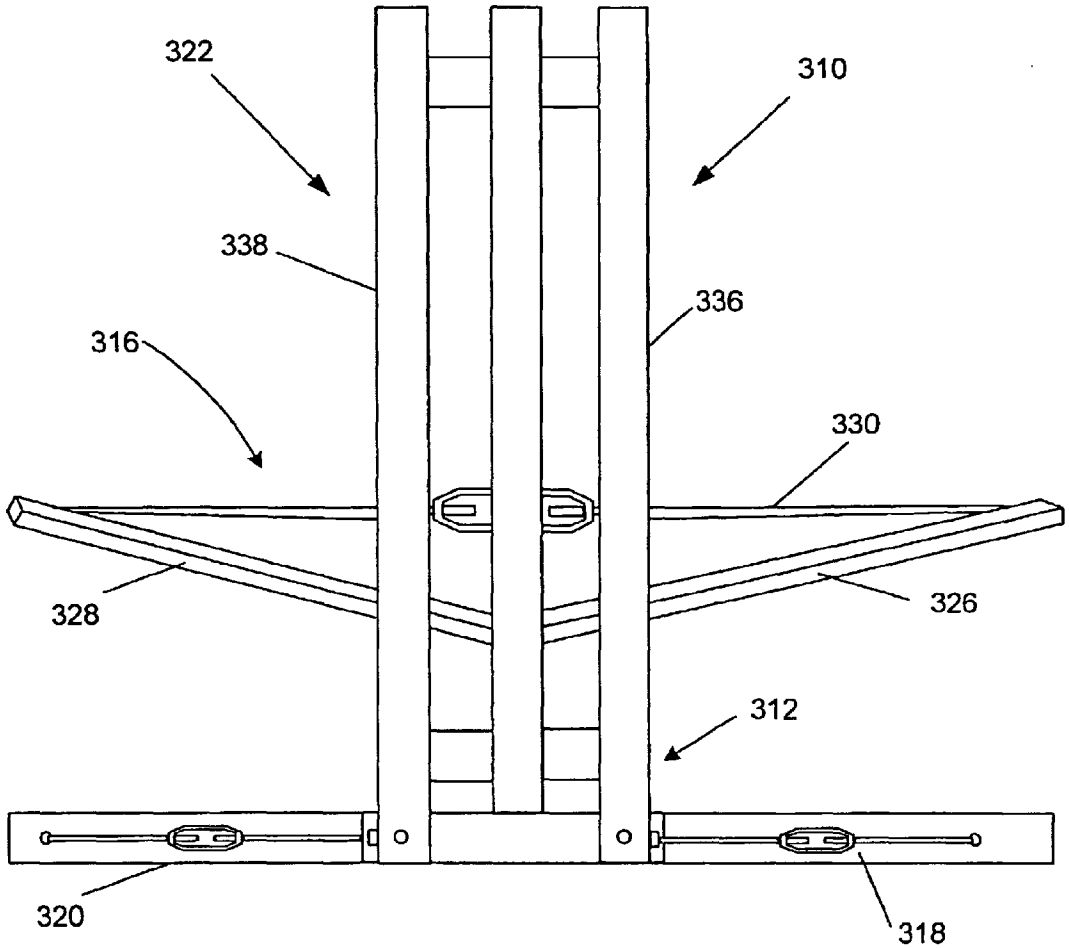
FIG. 14 is a rear view of the vehicle-mounted support of FIG. 13.

Referring now to FIGS. 12–14, a vehicle-mounted support 310 for a basketball goal system according to an embodiment of the invention is shown. Vehicle-mounted support 310 can provide a sturdy support for a basketball goal system at almost any location reachable by a vehicle. For example, using vehicle-mounted support 310 attached to a vehicle 300, a user could set up a basketball goal system in an open field, in the middle of street, or other location that lacks a suitable upright support. Vehicle-mounted support 310 generally includes a base 312, a ram 314 attached to a rear portion of base 312, a spreader bar 316 attached to ram 314, swing lock stabilization arms 318, 320, and an upright support 322 attached to base 312. As shown, vehicle 300 may include a pickup truck type vehicle. When installed into a pickup truck type vehicle, vehicle-mounted support 310 is mounted in the truck bed 302 of vehicle 300.

Base 312 rests in the truck bed 302 of vehicle 300 in a sliding arrangement, although other arrangements are possible, such as a bolted arrangement or a rolling arrangement. As with the basketball goal systems discussed previously, base 312 and other components of vehicle-mounted support 310 may be made from common materials, such as metal bars and/or tubing, plastic components, etc. For instance, base 312 may be made from a combination of steel and/or aluminium bars welded and/or bolted together. As shown, base 312 includes a hinge 324 attached to an adjustment bar 325 at its rear portion that connects to ram 314. Ram 314 is adapted to extend along its longitudinal axis to provide linear force. Ram 314 may include an adjustable ram, such as a screw jack or a hydraulic jack. It may further include an extensibly biased ram, such as a spring-loaded ram or a gas shock.

Pivotally attached to ram 314 at an opposite end from base 312 is spreader bar 316. Spreader bar 316 includes a pair of pivotally attached spreader arms 326, 328 connected at their distal regions by a spread limiter 330. Spread limiter 330 includes a turnbuckle mechanism that allows a user to adjust the spread of spreader arms 326, 328 relative to each other. In an alternative embodiment (not shown), spread limiter may include a pair of chains that are each attached to a respective one of spreader arms 326, 328, and which are adjustably connected via a hook at the end of one of the chains. Spread limiter 330 permits spreader arms 326 and 328 to be extended to substantially match the width of truck bed 302 and to engage the upper forward corners of the truck bed located behind the cab of truck 300. Spread limiter 330 also acts to prevent excessive spreading of spreader arms 326 and 328, and to thereby avoid damage to the walls of the truck bed.

Located along opposing lateral regions of base 312 are swing lock stabilization arms 318 and 320. Arms 318 and 320 are attached via hinges to their respective lateral regions of base 312, which allows them to swing outward at an angle toward the rear of vehicle 300. As such, arms 318 and 320 may engage the lower rear corners of truck bed 302. Turnbuckles 332 and 334 may be used to limit the outward rotation of arms 318 and 320 to reduce the risk of excessive shock to the walls of truck bed 302.

Upright support 322 is attached to base 312 at a rear portion of base 312, and includes a pair of posts 336 and 338. Posts 336 and 338 are oriented substantially perpendicular to base 312, which places them in a substantially vertical position when vehicle-mounted support 310 is installed on a vehicle 300. The face of posts 226 and 338 are preferably angled about 100 degrees from each other to match a preferable angle between standoffs 30, 32 of basketball goal systems 10, 110 and 210. The face of posts 226 may also have other angles to match other basketball goal mount systems. Further, the face of posts 336 and 338 may be substantially aligned in the same plane to provide a substantially planar attachment region.

The height of posts 336 and 338 may be about two to four feet to provide a large amount of contact and leverage support to an attached basketball goal system. Posts 336 and 338 are spaced apart within a range of twelve to eighteen inches to provide lateral support for oblique shocks to the attached basketball goal system. Preferably, posts 336 and 338 are spaced apart about 14 inches. Upright support 322 is preferably pivotally attached to base 312 to permit upright support 322 to pivot into a storage position substantially parallel with base 312.

Vehicle-mounted support 310 may be stored in a compact folded position when not in use. For example, swing lock stabilization arms 318 and 320 can be folded against the lateral sides of base 312. Also, spreader bar 316 may be collapsed such that spreader arms 326 and 328 are substantially parallel with each other. Further, collapsed spreader bar 316 and ram 314 may be rotated closer to base 312. Optionally, spreader bar 316 and ram 314 may be removed and stored separately. In addition, upright support 322 may be rotated into a position substantially parallel with base 312. In a folded position, support 310 does not require a large amount of storage space. Additionally, the folded support 310 may be easily installed by one or more users.

To install vehicle-mounted support 310 in truck 300, a user may slide support 310 into truck bed 302 such that spreader bar 316 is oriented toward the cab of truck 300. The user may then position the tips of each swing lock stabilization arm 318 and 320 to engage a respective bottom rear corner of truck bed 302. This may require adjusting the location of base 312. Turnbuckles 332 and 334 can be adjusted to set the swing angles of arms 318 and 320. Ram 314 may then be positioned along with spreader bar 316. Spreader bar 316 should be spread such that it engages the upper forward corners of truck bed 302. Consequently, ram 314 is angled downward from spreader bar 316 to base 312. Ram 314 may then be engaged to force base 312 rearward in an installed configuration. The angle of ram 314 allows ram 314 to provide both downward force and rearward force to the rear portion of base 312.

The downward force applied by ram 314 acts to counteract shocks encountered when playing basketball using an attached basketball goal system. A basketball goal system, such as system 110 discussed previously, may be attached to upright support 322. Because upright support 322 is located at the opposite end of base 312, the downward force provided by ram 314 counteracts downward shocks to attached goal system 110. The rearward force of ram 314 also maintains a sturdy mount to truck 300.

Upright support 322 may then be rotated into a substantially vertical position. To secure upright support 322 in a vertical position, bolts 340 can be used to secure posts 336 and 338 to a forward portion of base 322. A basketball goal system, such as system 10, may then be attached to upright support 322. For example, base 12 of system 10 may be secured against the faces of posts 336 and 338 using strap 14. After configuring basketball goal system 10 as discussed previously, the user has a sturdy, adjustable basketball goal system set up at the user's desired location.

While the present invention has been described in connection with the illustrated embodiments, it will appreciated and understood that modifications may be made without departing from the true spirit and scope of the invention. In particular, the invention applies to any basketball goal system or portion of a basketball goal system that provides adjustability in two or more directions to an attached backboard and/or rim.

I claim:

1. An adjustable basketball goal system comprising:

a base;

a neck coupled to the base;

a backboard interface system providing an interface for a basketball backboard and rim, the backboard interface system coupled to the neck and being pivotable about a first axis for orienting the backboard in a substantially vertical position and being pivotable about a second axis for orienting the rim in a substantially horizontal position; and a shock-absorbing mechanism for absorbing substantially downward shocks to the neck by permitting movement of the neck from an original position and returning the neck to the original position, the shock-absorbing mechanism including:

a shock absorber coupled to the base; and a cable connecting the shock absorber to the neck;

wherein the neck is pivotable about a third axis for disposing the rim at a desired height above a desired playing surface.

2. An adjustable basketball goal system comprising:

a base including an attachment device for attaching to an upright support;

a neck coupled to the base;

a backboard interface system providing an interface for a basketball backboard and rim, the backboard interface system coupled to the neck and being pivotable about a first axis for orienting the backboard in a substantially vertical position and being pivotable about a second axis for orienting the rim in a substantially horizontal position;

wherein the attachment device includes:

a first pair of angularly opposed standoffs defining a first angular region therebetween;

a second pair of angularly opposed standoffs defining a second angular region therebetween, the second angular region being aligned with the first angular region; and a securing strap.

3. The basketball goal system of claim 2, wherein the securing strap includes a ratcheting mechanism.

4. The basketball goal system of claim 2, wherein each standoff includes an end region, each end region being substantially disposed in the same plane for making contact with a substantially planar surface and permitting the standoffs to mount against the substantially planar surface.

5. The basketball goal system of claim 2, further including an upright support coupled to the attachment device.

6. The basketball goal system of claim 5, wherein the upright support includes a substantially vertical support adapted to couple to a vehicle.

7. The basketball goal system of claim 6, wherein the upright support further includes:

a sliding base having a first end, a second end, and a substantially horizontal foundation for making sliding contact with a bed of the vehicle, the second end being connected to the vertical support;

an angled support attached to the first end for coupling to the bed of the vehicle and for providing downward support and translational support to the sliding base; and a forward support for providing translation support to the sliding base in a direction opposite to the translational support provided by the angled support, the forward support attached to the first end of the sliding base and adapted to couple to the bed of the vehicle.

8. A portable basketball goal system adapted to removably attach to an upright support and to provide adjustment for irregularities in the plumb of the upright support, the portable basketball goal system comprising:

a base adapted to receive an upright support located in the vicinity of a desired playing surface;

an attachment mechanism for securing the base to the upright support;

a neck coupled to the base;

a backboard coupled to the neck and being pivotable about a first axis for orienting the backboard in a substantially vertical position;

a rim coupled to the backboard, the rim being pivotable with the backboard about a second axis for orienting the rim in a substantially horizontal position; and a shock-absorbing mechanism for absorbing substantially downward shocks to the neck by permitting movement of the neck from an original position and returning the neck to the original position, the shock-absorbing mechanism including:

a shock absorber coupled to the base; and a cable connecting the shock absorber to the neck.

9. The basketball goal system of claim 8, wherein the neck is pivotable about a third axis to permit the rim to be disposed at a desired height above the desired playing surface.

10. The basketball goal system of claim 8, wherein the neck includes:

a first portion coupled to the base;

a second portion coupled to the backboard; and a rotatable interface located between the first and second portions of the neck permitting the first and second portions of the neck to rotate relative to each other.

11. The basketball goal system of claim 8, wherein the base includes:

a first pair of angularly opposed standoffs defining a first angular region therebetween; and a second pair of angularly opposed standoffs defining a second angular region therebetween, the second angular region being aligned with the first angular region.

12. The basketball goal system of claim 11, wherein each standoff includes an end region, each end region being substantially disposed in the same plane for making contact with a substantially planar surface and permitting the standoffs to mount against the substantially planar surface.

13. The basketball goal system of claim 8, further including an upright support coupled to the attachment device.

14. The basketball goal system of claim 13, wherein the upright support includes a substantially vertical support coupled to a vehicle.

* * * * *